US005329654A

United States Patent [19]

Sherman

[11] Patent Number: 5,329,654

[45] Date of Patent: Jul. 19, 1994

[54] FURNITURE SYSTEM

[76] Inventor: Ronald K. Sherman, 3100 N. Andrews Ave., Pompano Beach, Fla. 33064

[21] Appl. No.: 933,374

[22] Filed: Sep. 24, 1992

Related U.S. Application Data

[63] Continuation-in-part of Ser. No. 702,910, May 20, 1991, abandoned.

[51] Int. Cl.[5] ..... A47C 17/12; A47C 17/22

[52] U.S. Cl. ..... 5/14; 5/12.2; 5/53.2; 5/52; 5/59.1; 297/218; 297/116

[58] Field of Search ..... 297/218, 219, 223, 226, 297/227, 417, 115, 116; 5/12.2, 14, 52, 53.1, 53.2, 54, 57.1, 59.1

[56] References Cited

U.S. PATENT DOCUMENTS

| | | | |
|---|---|---|---|
| 446,874 | 2/1891 | Mee | 297/116 |
| 1,336,062 | 4/1920 | Arton | 297/116 X |
| 1,720,842 | 7/1929 | Keinath | 297/116 |
| 2,069,604 | 2/1937 | Elliman | 5/59.1 |
| 2,313,878 | 3/1943 | Kline | 297/219 X |
| 2,723,401 | 11/1955 | Brede-Horst | 5/59.1 X |
| 3,128,123 | 4/1964 | Schreier | 5/52 X |
| 3,695,690 | 10/1972 | Carson | 297/218 |
| 3,857,120 | 12/1974 | Acker | 5/52 X |
| 5,129,113 | 7/1992 | Sherman | 5/14 X |

FOREIGN PATENT DOCUMENTS

| | | | |
|---|---|---|---|
| 339346 | 6/1959 | Switzerland | 5/59.1 |
| 944180 | 12/1963 | United Kingdom | 297/226 |

*Primary Examiner*—Michael F. Trettel
*Attorney, Agent, or Firm*—M. K. Silverman

[57] ABSTRACT

A sofa system includes a unitary perimetric baseframe including a front panel, a rear panel and opposing side panels. The system also includes a hollow back portion having front and rear edges and an integral internal rigid frame, the back portion rotationally mounted between the side panels and to the rear panel by rear longitudinal hinge elements secured between said rear edge of a top portion and the rear panel. The system also includes a unitary seat portion having a front and rear edge and a rigid base, in which the seat portion is rotationally mounted between the side panels and to the front panel by a front longitudinal hinge element that is secured between the front edge of the rigid base of the seat portion and the front panel. Arms may, if desired, be rotationally mounted to the sides of the baseframe.

10 Claims, 6 Drawing Sheets

FURNITURE SYSTEM

REFERENCE TO RELATED APPLICATION

This case is a continuation-in-part of application Ser. No. 07/702,910, filed May 20, 1991, entitled convertible Sofa Bed System, now abandoned.

BACKGROUND OF THE INVENTION

The present invention relates to a method and structure of furniture construction and, more particularly, relates to a method and structure of furniture construction in which certain of the elements thereof, namely, the back and seat, may be pivoted rotationally away from the baseframe of the structure to permit ease of change and/or removal of the fabric or upholstery upon the back and seat portions thereof.

The present invention is an improvement over both my U.S. Pat. No. 4,932,720 (1990) entitled Modular Furniture System and U.S. Pat. No. 5,129,113 (1992) entitled System of Fabric Covering. The instant invention, however, differs from my modular furniture system, primarily in that the hollow unitary back portion thereof is rotationally mounted to the rear panel of the structure, while the unitary seat element is rotationally mounted to the front panel of the baseframe of the structure.

In the prior art, the change and removal of upholstery or fabric from sofas, sofa beds, convertible beds, love seats, sofa chairs, and the like, has constituted a difficult, expensive, and time-consuming process such that the typical cost of re-upholstering a sofa or sofa bed has been in the range of $700 to $3000. Accordingly, as a practical matter, sofa, sofa beds and like structures, are rarely re-upholstered, because the cost of re-upholstering comprises an unacceptably large percentage of the cost to replacing the entire sofa. Further, even in those instances where cost is not a constraint for a particular consumer, it is generally necessary to have a sofa, or at least the seat and back cushions thereof, taken off premise such that appropriate re-fabricing thereof may be done at a manufacturing site.

Also, in most prior art sofa, sofa beds, sofa chairs, and the like, fabric is employed as a covering of portions of the structure, other than the seat and back cushions thereof. When this occurs, it is almost mandatory that the entire structure be taken off premise for replacement of the fabric or, alternatively, that a portion of the premises of the sofa owner be effectively converted into a "factory location" while the re-upholstering is accomplished.

The present invention thereby addresses the problem of change of fabric of a sofa-like structure through the provision of a system having some similarities to my said U.S. Pat. No. 4,932,720 and U.S. Pat. No. 5,129,112, in which, the respective back and seat portions thereof are rotationally mounted, as by hinge means, to the respective rear and front panels of the structure, as is more fully described below.

In the prior art it is known to make use of hinge means in furniture construction, however, for purposes completely different from the purposes for which hinge means are employed in the instant invention. For example, the use of hinge means in a sofa bed is shown in U.S. Pat. No. 3,654,642 (1972) to Barabas, entitled Hinge Seat Platform For Sofa-Bed and in U.S. Pat. No. 4,204,287 (1980) to Laine, entitled Knock-down Sofa Bed With Hinge Mattress. In these structures the supporting frame for a sofa mattress is, by various means including hinge means, mechanically connected to the base frame of the structure. As such, there is no aspect of these structures that employ hinge means for the purpose of facilitating ease of change of upholstery.

In U.S. Pat. No. 3,226,157 (1965) to Reinfeldt, entitled Covering For Seats Having Hinged Back, there is shown a system, adapted for use with car seats and the like in which, through the use of a back portion which is hinged relative to a base portion, certain advantages are achieved including ease in the installation and change of the upholstery of the seat. Similarly, U.S. Pat. No. 3,995,892 (1976) to Hellman, entitled Seat Cover Fastening System, teaches a fastening system for rapid assembly and installation of the upholstery of an auto seatcover and, further, teaches the use of a split tube element as a means of releaseability holding fabric in place. While the inventive system may, in certain embodiments, make use of such a split tube element for fabric securement and release, the teaching of Hellman, and the other prior art referenced above, bears little similarity to Applicant's invention when viewed as a system.

SUMMARY OF THE INVENTION

My inventive sofa system includes a unitary perimetric baseframe including a front panel, a rear panel and opposing side panels. The system also includes a hollow back portion having front and rear edges and an integral internal rigid frame, said back portion proportioned for positioning between said side panels, said back portion selectably rotationally mounted to said rear panel by rear longitudinal hinge means secured between said rear edge of a top portion and said rear panel. The system yet further includes a unitary seat portion having front and rear edges of an integral rigid base, in which said seat portion is selectably rotationally mounted between said side panels and to said front panel by front longitudinal hinge means that are secured between said front edge of said rigid base and said front panel.

Upon the above described structure is provided releasable longitudinal fabric securement means mounted on said rear panel co-linearly with and proximal to said rear longitudinal hinge means. Also provided are means for selectable fabric attachment secured upon said front edge of said back portion. Yet further provided are releasable front longitudinal fabric securement means mounted on said front panel co-linearly with and proximally to said front longitudinal hinge means. Finally, there are provided means for selectable fabric attachment secured upon said rear edge of said seat portion, whereby upholstery may be selectably attached to and detached from said back and seat portions by co-action with said fabric securement and attachment means.

The side and front panels of a system of the above type may be formed of a constructional wood, such as fir, and surrounded with a suitable exterior furniture material such as wicker or rattan.

It may, accordingly, be appreciated that it is an object of the instant invention to provide a furniture system in which the back and seat units thereof may be integrally rotated off of the baseframe of the structure for purposes of facilitating application and change of the fabric or upholstery thereof.

It is another object of the present invention to provide a furniture system of the above type in which the upholstery thereof may be conveniently and cost-effectively replaced by a consumer/owner of the system without use of specialized tool or special skills.

It is a further object of the invention to provide a furniture system, in the nature of a sofa, sofa bed, sofa chair, love seat and the like, that may be constructed on a more lifetime of product cost-effective basis than those known in the prior art, while attaining the above objectives of ease of application and replacement of the upholstery thereof.

The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
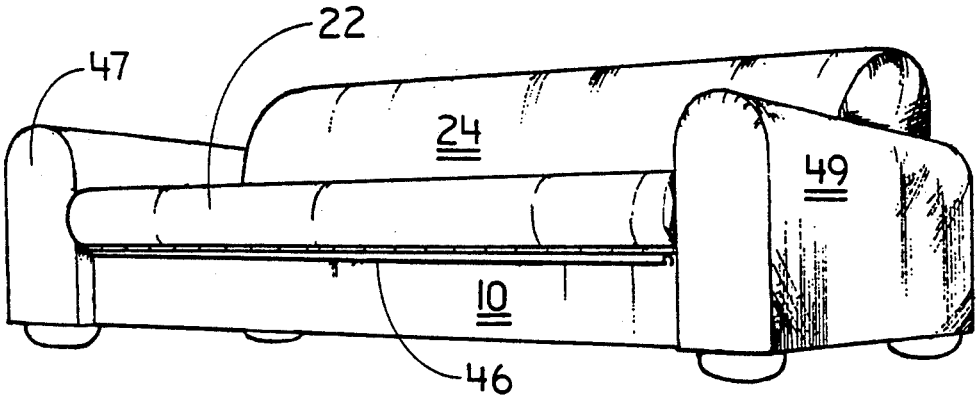
FIG. 1 is a perspective view of a completed sofa, without fabric thereon, constructed in accordance with the present invention.
Figure 2:
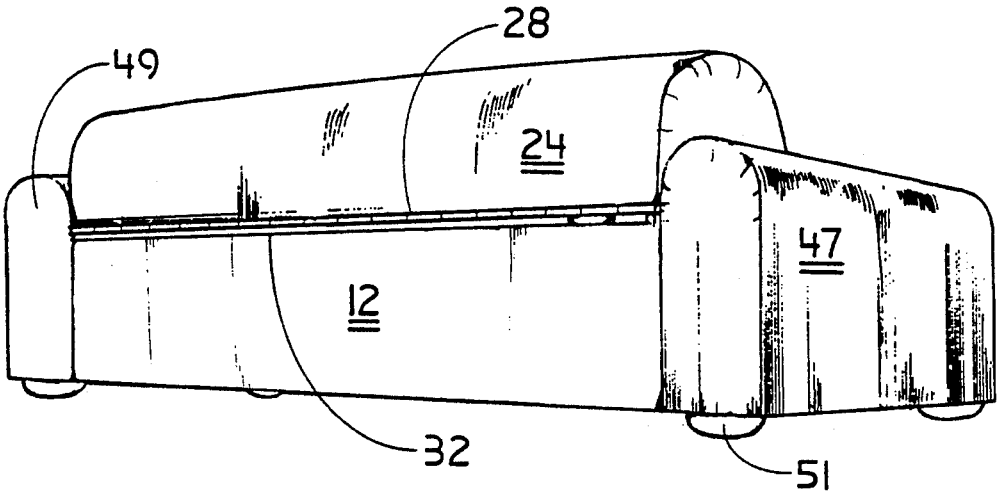
FIG. 2 is a rear perspective view of the inventive sofa of FIG. 1.

With reference to the perspective view of FIG. 1 there is shown a sofa reflective of one design of sofa which may be constructed in accordance with the principles of this invention, which are set forth below. FIG. 2 is a rear perspective view of FIG. 1.

Figure 5:
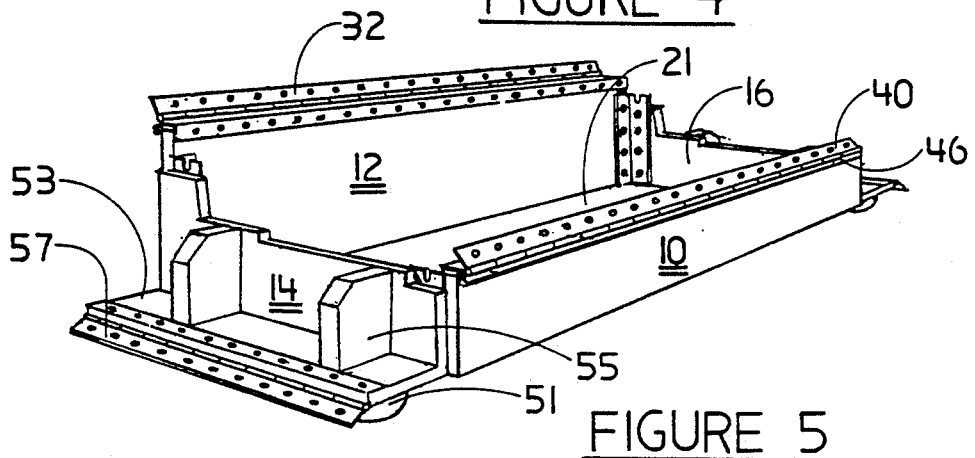
FIG. 5 is a perspective view showing the perimetric base frame of the sofa system and related hinge elements, without fabric thereon.

There is, in the instant invention, employed a particular combination of baseframe and hinged modular elements which render possible the practice of rapid and cost-effective change of upholstery. The basic structure upon which this change of upholstery system is based is one which includes a unitary perimetric baseframe which is defined by the rigid mechanical combination of a front panel 10 (see FIGS. 5 and 6), a rear panel 12 and opposing side panels 14 and 16. As may be noted in the view of FIG. 6, each of said elements are secured together through the use of angle irons 18 or means equivalent thereto.

Figure 8:
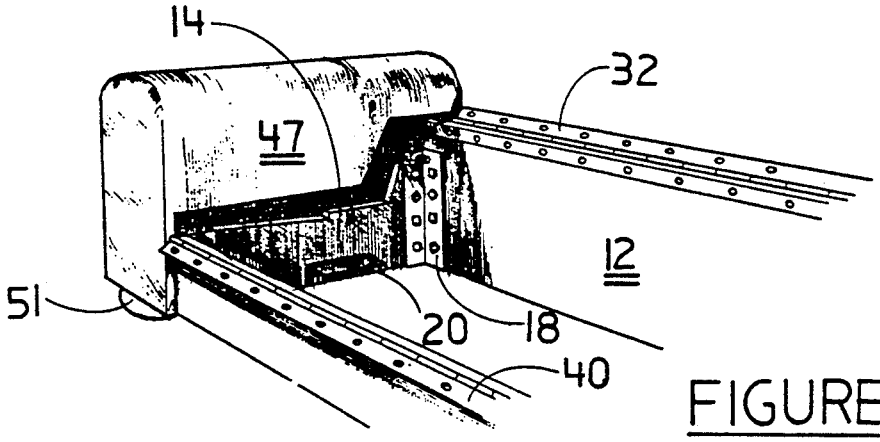
FIG. 8 is a view, similar to the view of FIG. 7, however, showing the sofa arm in closed position.

With reference to the view of FIG. 8, side panels 14 and 16 are provided with inwardly directed transverse stops 20 which act as a positioning means for seat portion 22, more fully described below, when the sofa system is used without a convertible bed mechanism. In other words, where a convertible bed mechanism is not used, transverse stops 20 act as a means of vertically positioning seat portion 22 relative to the floor. Where a sofa bed mechanism is placed within the cavity 21, it is not necessary to have said stops 20 in the system at all.

Figure 4:
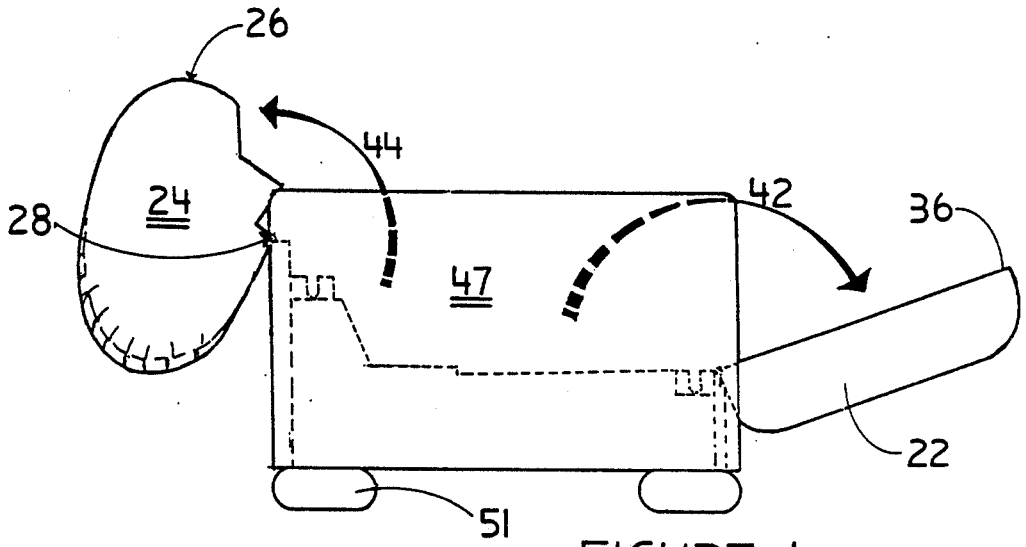
FIG. 4 is a side plan view showing the sofa seat and back in open position.
Figure 6:
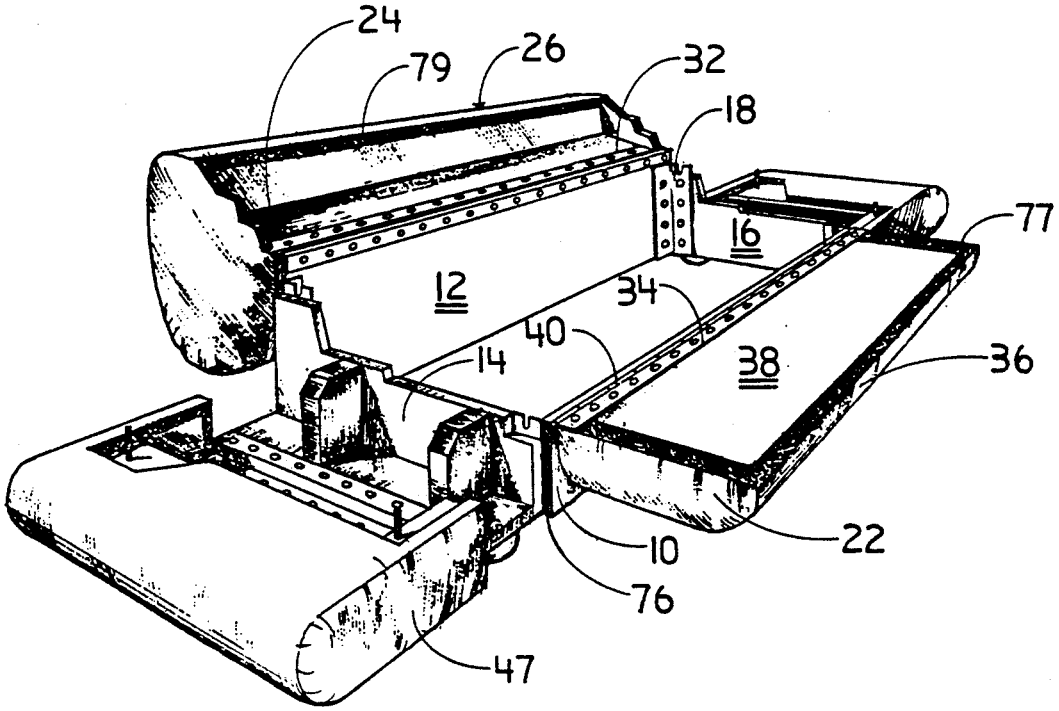
FIG. 6 is a view, similar to the view of FIG. 5, however also showing the hinged back, seat, and arm portions in perspective view.

With reference to the perspective views of FIGS. 2, 4 and 6, there is shown a partially hollow back portion 24 which includes a front edge 26 and a rear edge 28. Said back portion 24, although partially hollow, is defined by an integral internal frame such that it possesses sufficient rigidity for use as the back portion of the sofa or any like means such as a love seat or sofa chair. It is noted that back portion 24 also includes padding which is, of course, a necessary aspect of a back portion of any sofa.

Figure 3:
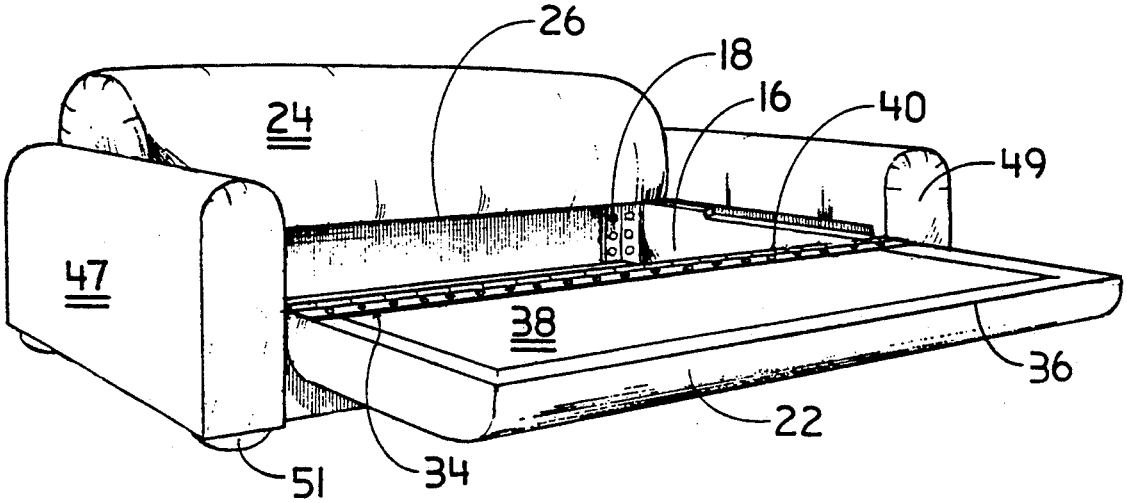
FIG. 3 is a perspective view showing the seat portion of the sofa in open position.

It may, with reference to FIGS. 3 and 4, be noted that back portion 24 is proportioned for rotational movement between said side panels 14 and 16 and, further, that the back portion 24 is mounted to said rear panel 12 through the use of rear longitudinal hinge means 32 (see FIG. 2) which may be in the nature of a piano hinge, to obtain rotational motion 44. As may be noted therein, hinge means 32 is secured between rear edge 28 of back portion 24 and an upper edge of said rear panel 12.

With further reference to unitary seat portion 22, it is noted that said seat portion is provided with a front edge 34 and a rear edge 36 which appears forwardly of front edge 34 when the seat portion 22 is rotated into its forward position as is shown in FIGS. 3 and 4. The seat portion 22 includes an integral rigid internal frame (not shown) and a substantially rigid flat bottom surface 38 thereof (see FIG. 3). Said rigid surface may, for example, comprise wood, metal or resilient suspension means.

As may be noted in the views of FIGS. 3 through 6, by the use of front longitudinal hinge means 40, front edge 34 of seat portion 22 is secured to an upper edge of front panel 10 to thereby provide the forward and backward rotational capability indicated by arrow 42 in FIG. 4.

In the preferred embodiment of the instant invention, the above described structure is also provided with left and right sofa arms 47 and 49 which rest upon sofa feet 51. See FIG. 3. The manner of attachment of said sofa arms 47 and 49 to the above described perimetric frame is particularly shown with reference to the views of FIGS. 5 through 8. Therein, as may be noted, there is provided a corner assembly 53 which is provided with support and spacing members 55. Further provided with each sofa arm corner structure is a transverse hinge 57 (see FIGS. 5 to 7), to which the sofa arms are connected. As may be noted the arms 47 and 49 are hollow in their lower aspect so that members 55 can be cleared when they are closed against the side panels.

To facilitate the securement of each of the sofa arms to the respective side panels, there are provided bolt means 56 and 61 which are complemental with recesses respectively within side panel 14 and angle irons 18. Accordingly, in the manner shown in FIGS. 7 and 8, said bolts of arm 47 may be positioned into said recesses within side panel 14 and, thereupon, wing nuts or like means may be employed to provide a so-called positive securement of arm 47 relative to side panel 14. Arm 49 and side panel 16 exhibit a similar securement assembly.

Figure 7:
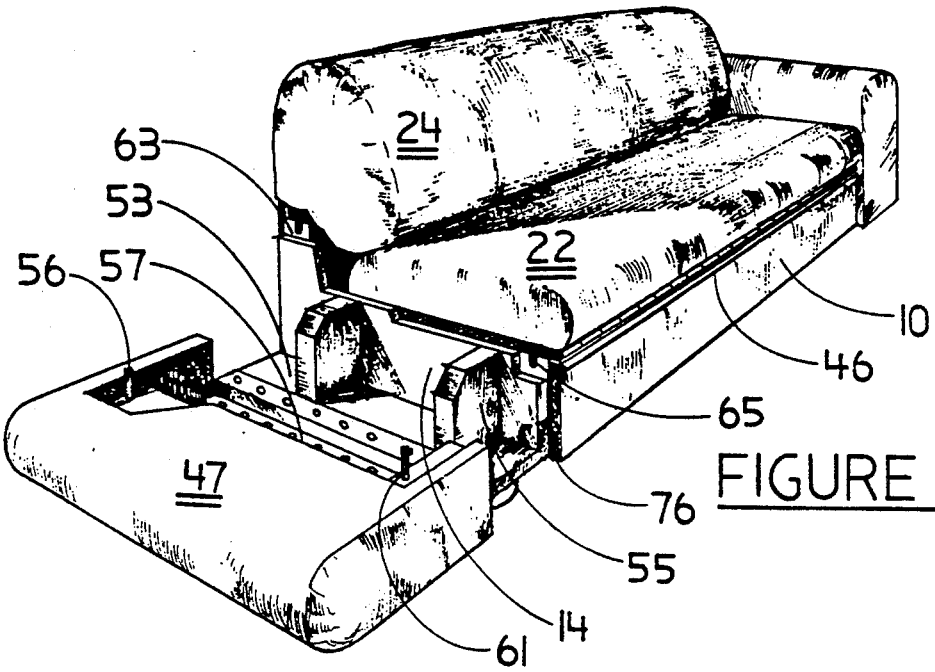
FIG. 7 is an enlarged view of the sofa arm and side part of the inventive system, showing the sofa arm in open position.
Figure 10:
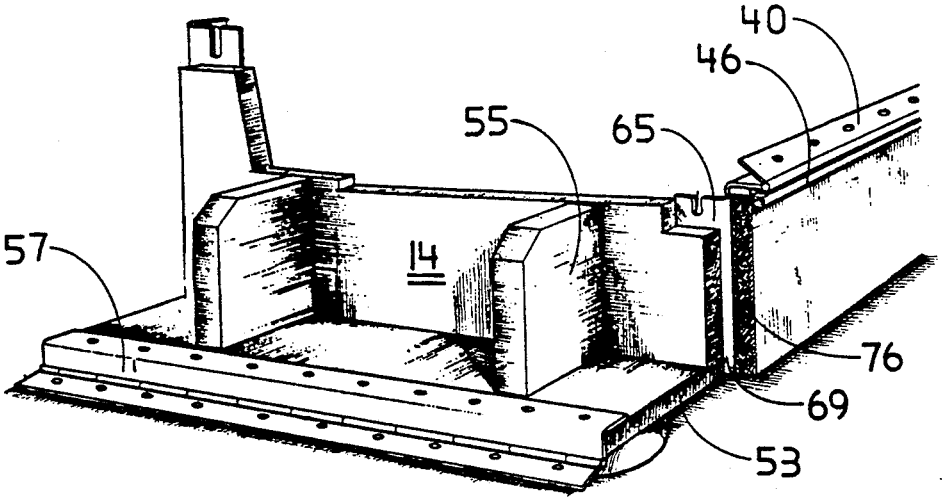
FIGS. 10 and 11 are diagonal and top views of the region of intersection between the front and side panels.
Figure 11:
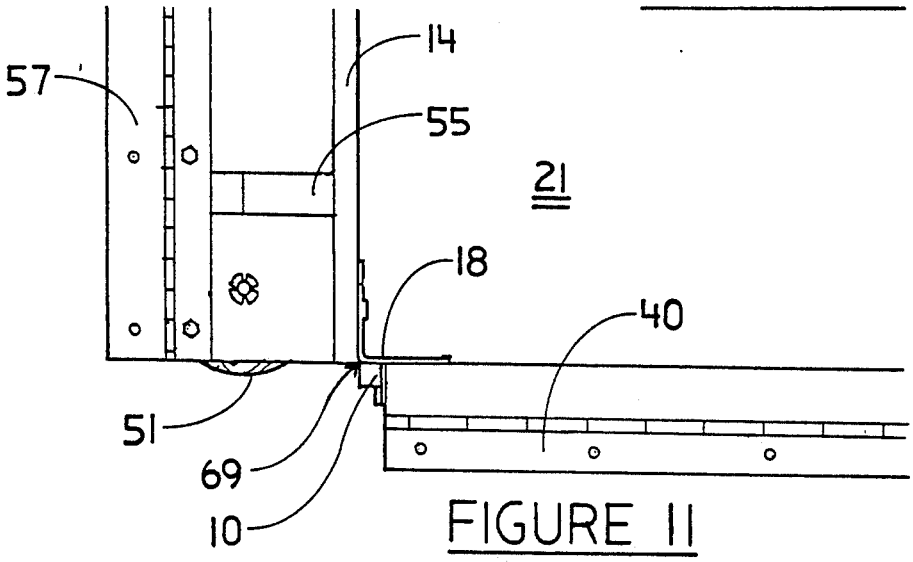
Figure 12:
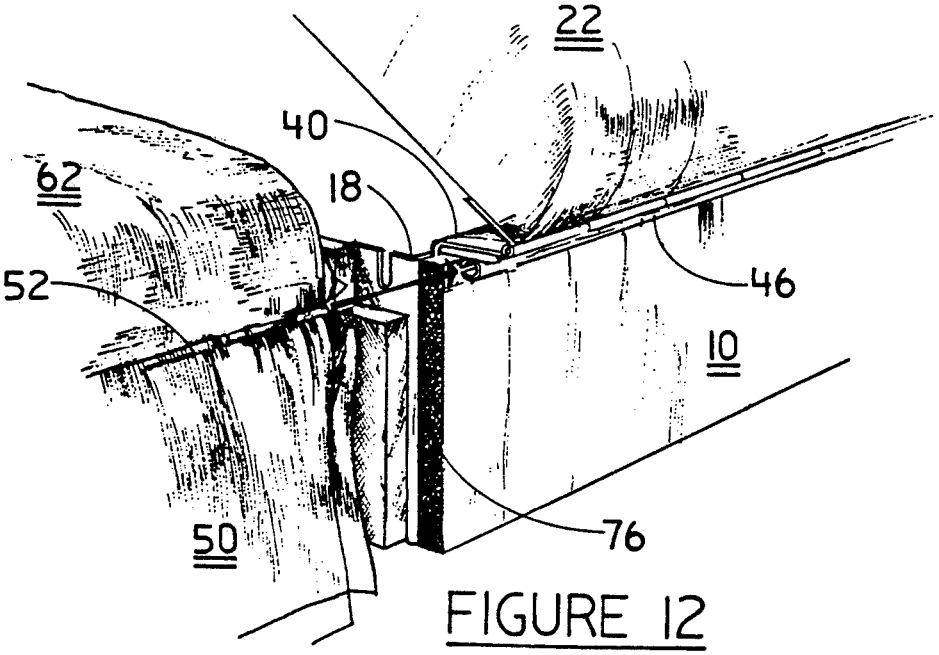
FIGS. 12 and 13A are perspective views, showing the method of attachment of a fabric cover to the front panel.

The structure of the sofa arm corner assemblies 53 may be further appreciated with reference to the views of FIGS. 7, 10, and 11. Therefrom it may be appreciated that the structure of the sofa arm corner assemblies, at all corners of the sofa, are essentially that of inverted corners. As may be noted in FIGS. 10 and 11, there exists, at the intersection of panels 10 and 14, a geometry which may be viewed as an inverted corner. The existence of the four intersections 69 is significant in terms of the provision of the hook and loop fastening means (hereinafter referred to as VELCRO means) 76 and 84 at the two arm 47 intersections 69 and the two intersection 69 of arm 49 for attachment and change of upholstery, more fully described below.

With reference to the views of FIGS. 9 and 12 through 15 there is shown the upholstery/fabric attachment and removal aspect of the instant invention. There is, more particularly, in the views of FIGS. 10 through 13, shown a slotted longitudinal front cylinder 46 which constitutes a front releasable fabric securement means. Said slotted longitudinal cylinder 46 is mounted co-linearly with the top edge of front panel 10 and, additionally, is mounted co-linearly with said front hinge 40. Therein, it may be noted that front hinge 40 is mounted directly on top of said slotted longitudinal front cylinder 46.

Figure 13A:
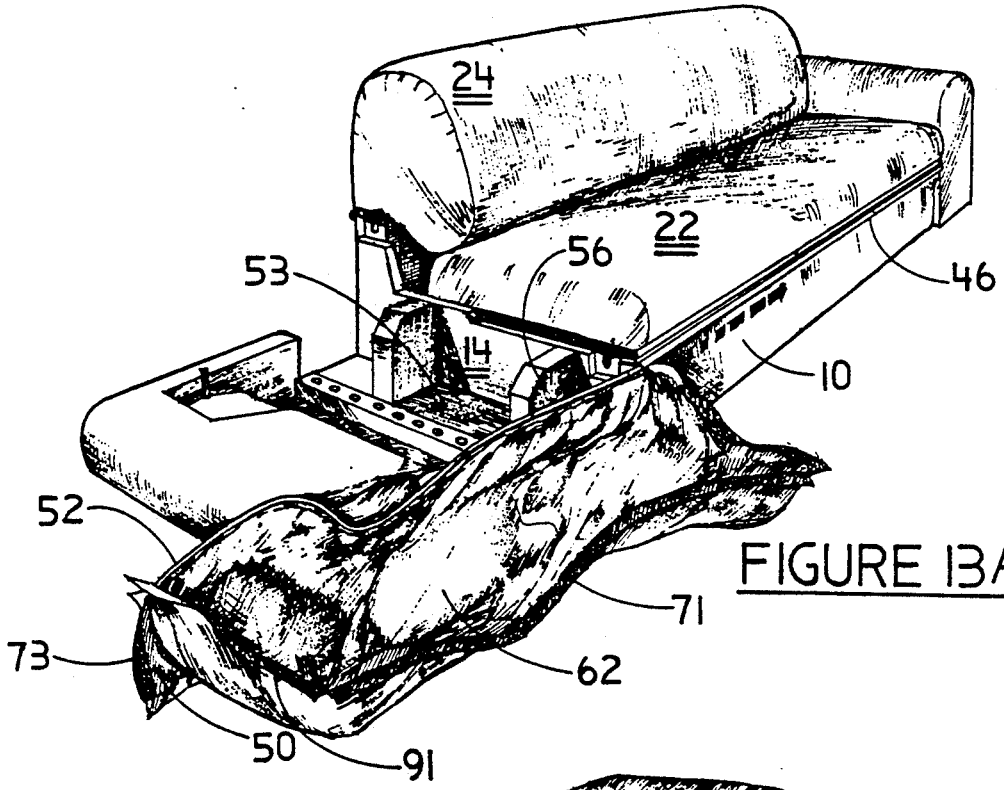
Figure 13B:
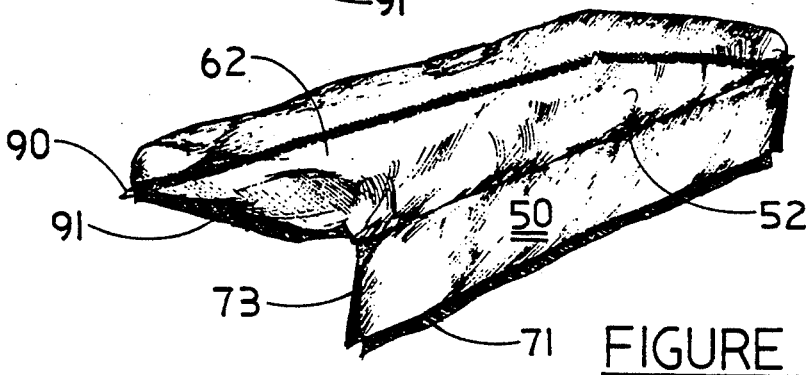
FIG. 13B is a perspective view of the fabric cover for the front panel and seat portion of the sofa.

The attachment of fabric to covers front panel 10 and seat portion 22 is effected in the manner shown in FIGS. 13A and 13B. More particularly, with reference to front panel 10, there is provided, a front fabric portion 50, an integrally-formed rope 52, and a seat fabric portion 62 which rope is slidable insertable within the slot of said slotted front cylinder 46. As may be noted in FIGS. 13A and 13B, fabric portions 50 and 62 are, at the edges thereof, provided with VELCRO means 71 and 73, and 90 and 91, respectively, which may be secured to complemental VELCRO means 76 (with regard to VELCRO 73) at the sides of the front panel and with regard to other VELCRO (not shown) underneath front panel 10. It is further noted that after front fabric portion 50 has been pulled completely into slotted cylinder 46, seat fabric portion 62 is pulled over seat portion 22 so that VELCRO means 90 and 91 may be secured to the inner edges of rigid bottom 38 of the seat portion. See FIG. 6. Accordingly, as may be appreciated from the views of FIGS. 12 and 13, the changing of the upholstery of front panel 10 is a simple matter of sliding rope 52 in or out of slotted cylinder 46 and then attaching the fabric portions 50 and 62 using the VELCRO means associated therewith.

Figure 9:
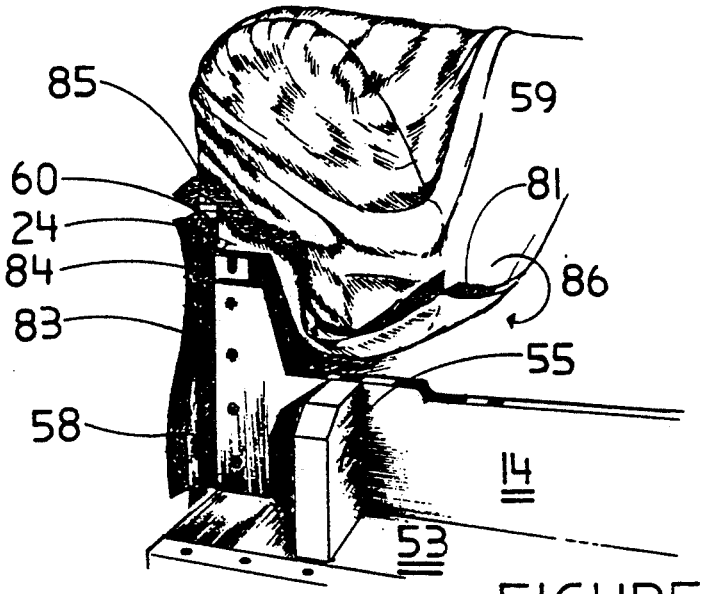
FIG. 9 is a first view showing the fabric attachment means associated with the back panel of the system.
Figure 14A:
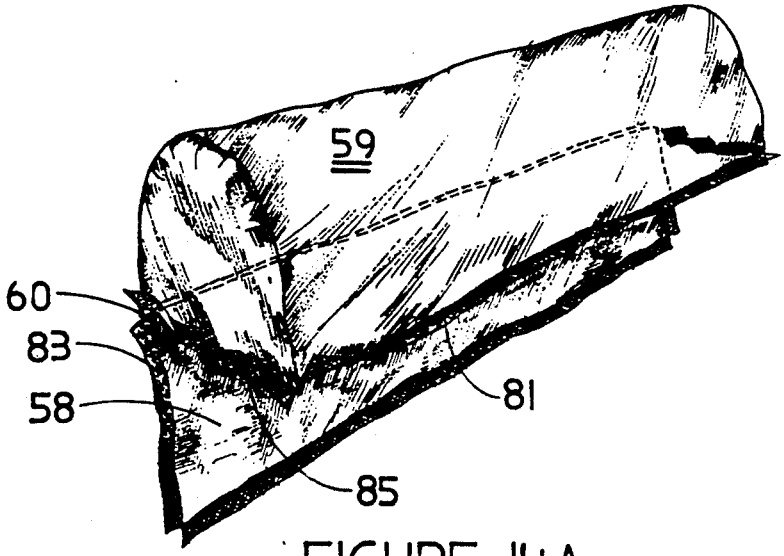
FIG. 14A is a perspective view of the fabric cover for the back portion and rear panel of the sofa.
Figure 14B:
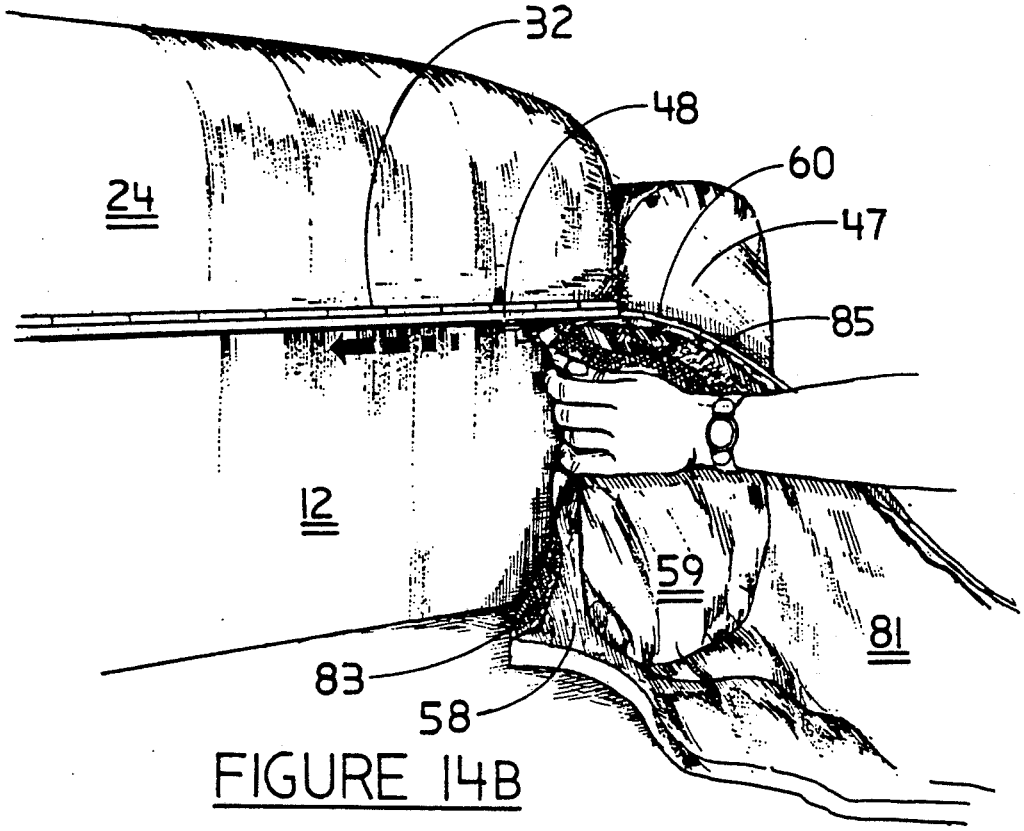
FIG. 14B is a view, sequential to the views of FIGS. 9 and 14A, showing application of a fabric cover to the back panel of the sofa system.

In FIGS. 9 and 14B are shown back slotted cylinder means 48. As in the case of the front securement means, the slotted longitudinal back cylinder 48 is mounted directly beneath back hinge 32, that is, hinge 32 and slotted longitudinal rear cylinder 48 are mounted co-linearly at the top edge of rear panel 12.

With respect to fabric 58 and 59 which cover back panel 12 and sofa back portion 24, an analogous system is employed. More particularly, with reference to FIGS. 9, 14A and 14B, it may be seen that an integrally formed rope 60 between fabric areas 58 and 59 is slid within rear longitudinal slotted cylinder 48 to effect the covering of the rear panel 12. After fabric area 58 has been slid into place, edges 83 thereof are attached to the edges of rear panel 12 in a fashion analogous to that above described with reference to fabric area 58 which covers front panel 10, that is, VELCRO is used at the edges of fabric 50 to secure it to the edges of the back panel which are also provided with VELCRO. With regard to the fabric area 59, it is pulled over sofa back portion 24 after said fabric area 58 is in place. VELCRO means 85 are secured underneath the sides of back portion 24, while horizontal VELCRO means 81 (see FIGS. 9 and 14A) are secured to VELCRO means 79 (see FIG. 6) using rotational motion 83 shown in FIG. 9.

Figure 15:
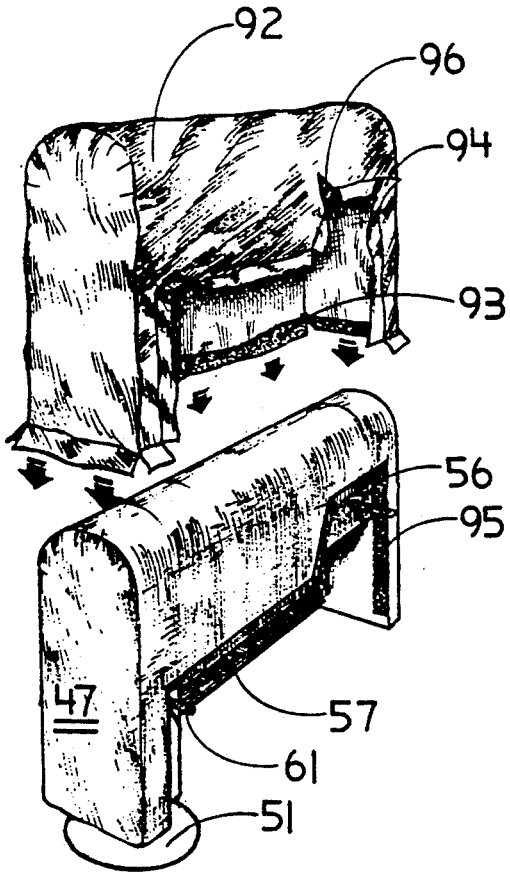
FIG. 15 is an exploded view of a side arm fabric cover relative to the side arm.

With respect to the fabric upon the arms 47 and 49, arm covers 92 shown in FIG. 15 may be easily employed to change the fabric thereof. Provided therein are VELCRO means 93 and 94. Said means mates with VELCRO means 95 on arm 47. Voids 96 are provided in covers 92 to accommodate bolts 59 and 61 of the arms 47 and 49.

Accordingly, while there has been shown and described the preferred embodiment of the instant invention it may be appreciated that the invention may be embodied otherwise than is herein specifically shown and described and that within said embodiment, certain changes may be made within the forms and arrangements of the parts without departing from the underlying ideas or principles of this invention within the scope of Claims appended herewith.

Having thus described my invention, what I claim as new, useful and non-obvious and, accordingly, secure by Letters Patent of the United States is:

1. A furniture structure, comprising:

(a) a integral perimetric baseframe including a front panel, a rear panel and opposing side panels;

(b) a partially hollow back portion having front and rear edges and an integral internal rigid frame, said back portion selectably rotatably mounted between said side panels and to said rear panel by rear longitudinal hinge means secured between said rear edge of said back portion and said rear panel; and (c) a seat portion having front and rear edges, an integral internal frame, and a rigid base, said seat portion selectably rotatably mounted between said side panels and to said front panel by front longitudinal hinge means secured between a front edge of said rigid base of said seat portion and said front panel of said baseframe.

2. The structure is recited in claim 1, further comprising:

(a) rear releasable longitudinal fabric securement means mounted on said rear panel co-linearly with, and proximally to, said rear longitudinal hinge means;

(b) means for selectable fabric attachment secured upon said front edge of said back portion;

(c) front releasable longitudinal fabric securement means mounted on said front panel co-linearly with, and proximally to, said front longitudinal hinge means; and (d) means for selectable fabric attachment secured upon said rear edge of said seat portion, whereby upholstery may be selectably attached and detached to said back and seat portions by co-action between said fabric securement and attachment means.

3. The structure as recited in claim 2 further comprising: upholstery proportioned to external surfaces of said back and seat portions and having, upon internal surfaces thereof, means for detachable securement to said fabric securement and attachment means.

4. The structure as recited in claim 3 in which both of said releasable securement means comprise cylinders, each cylinder having a slot along the entire length thereof.

5. The structure as recited in claim 3 in which both of said selectable and detachable securement means comprise hook and loop fastener.

6. The structure as recited in claim 5, further comprising arm portions rotatably secured by hinge means to each of said side panels of said baseframe.

7. The structure as recited in claim 3 in which said panels of said perimetric baseframe include: inwardly directed transverse stop means for control of an angulation of said seat portion.

8. The structure as recited in claim 1, further comprising arm portions rotatably secured by hinge means to each of said side panels of said baseframe.

9. The structure as recited in claim 3, further comprising arm portions rotatably secured by hinge means to each of said side panels of said baseframe.

10. A furniture structure, comprising:

(a) a integral perimetric baseframe including a front panel, a rear panel and opposing side panels;

(b) a hollow back portion having front and rear edges and an integral internal rigid frame, said back portion selectably rotatably mounted between said side panels and to said rear panel by rear longitudinal hinge means secured between said rear edge of said back portion and said rear panel;

(c) a seat portion having front and rear edges, an integral internal frame, and a rigid base, said seat portion selectably rotatably mounted between said side panels and to said front panel by front longitudinal hinge means secured between a front edge of said rigid base of said seat portion and said front panel of said baseframe; and (d) left and right arm portions selectably rotatably secured by hinge means to lower areas of each of said opposing side panels of said baseframe.

* * * * *